US009938795B2

(12) United States Patent
Hoang

(10) Patent No.: US 9,938,795 B2
(45) Date of Patent: Apr. 10, 2018

(54) MULTI-BARRIER SEAL SYSTEM

(71) Applicant: Cameron International Corporation, Houston, TX (US)

(72) Inventor: Loc Gia Hoang, Houston, TX (US)

(73) Assignee: Cameron International Corporation, Houston, TX (US)

( * ) Notice: Subject to any disclaimer, the term of this patent is extended or adjusted under 35 U.S.C. 154(b) by 215 days.

(21) Appl. No.: 14/795,688

(22) Filed: Jul. 9, 2015

(65) Prior Publication Data

US 2016/0032679 A1 Feb. 4, 2016

Related U.S. Application Data

(63) Continuation of application No. 13/528,773, filed on Jun. 20, 2012, now Pat. No. 9,097,082.

(51) Int. Cl.

| | |
|---|---|
| ***E21B 29/04*** | (2006.01) |
| ***E21B 33/03*** | (2006.01) |
| ***E21B 33/06*** | (2006.01) |
| ***E21B 33/068*** | (2006.01) |
| ***E21B 33/035*** | (2006.01) |

(52) U.S. Cl.

CPC ..... *E21B 33/068* (2013.01); *E21B 29/04* (2013.01); *E21B 33/0355* (2013.01); *E21B 33/063* (2013.01)

(58) Field of Classification Search

CPC ..... E21B 29/04; E21B 33/03; E21B 33/061; E21B 33/062; E21B 33/063; E21B 33/072

See application file for complete search history.

(56) References Cited

U.S. PATENT DOCUMENTS

| | | | | |
|---|---|---|---|---|
| 3,223,100 | A | 12/1965 | Koenig et al. | |
| 4,215,749 | A * | 8/1980 | Dare | E21B 29/04 137/68.13 |
| 4,347,898 | A | 9/1982 | Jones | |
| 4,531,585 | A | 7/1985 | Hansen | |
| 4,612,983 | A | 9/1986 | Karr, Jr. | |
| 4,911,410 | A | 3/1990 | Baker | |
| 5,501,424 | A | 3/1996 | Williams et al. | |
| 5,803,431 | A | 9/1998 | Hoang et al. | |
| 6,244,336 | B1 * | 6/2001 | Kachich | E21B 29/08 166/55 |
| 6,289,992 | B1 | 9/2001 | Monjure et al. | |
| 6,454,015 | B1 * | 9/2002 | Armstrong | E21B 29/04 166/373 |
| 8,353,338 | B2 | 1/2013 | Edwards | |
| 2003/0116733 | A1 | 6/2003 | Hoang et al. | |
| 2010/0102263 | A1 | 4/2010 | Liew | |

OTHER PUBLICATIONS

International Search Report and Written Opinion for PCT Application No. PCT/US2013/034173 dated May 13, 2014; 15 pgs.
U.S. Appl. No. 62/152,682, filed Apr. 24, 2015, Loc Hoang.

* cited by examiner

*Primary Examiner* — Cathleen Hutchins
(74) *Attorney, Agent, or Firm* — Fletcher Yoder, P.C.

(57) ABSTRACT

A multi-barrier seal system, including, a first seal assembly configured to provide a first sealing barrier between an auxiliary line and a mineral extraction system, and a second seal assembly configured to provide a second sealing barrier between the auxiliary line and the mineral extraction system, wherein the second seal assembly is configured to shear through the auxiliary line.

18 Claims, 5 Drawing Sheets

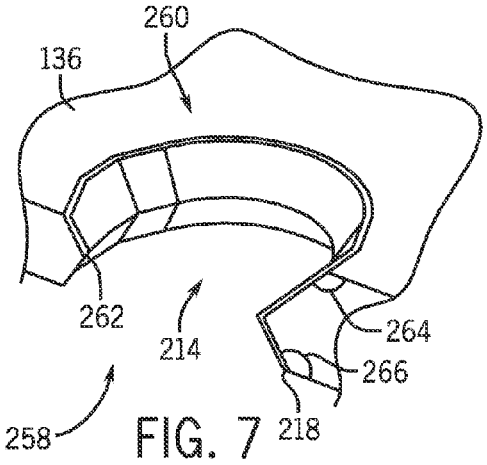
FIG. 7
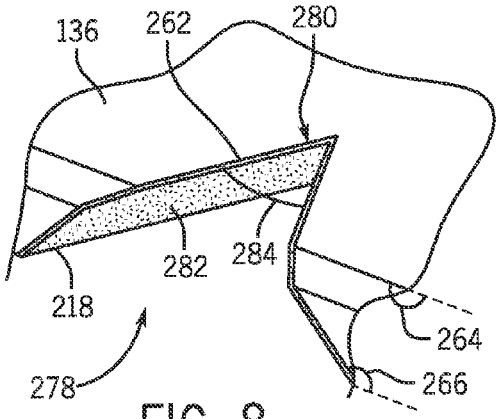
FIG. 8
FIG. 9
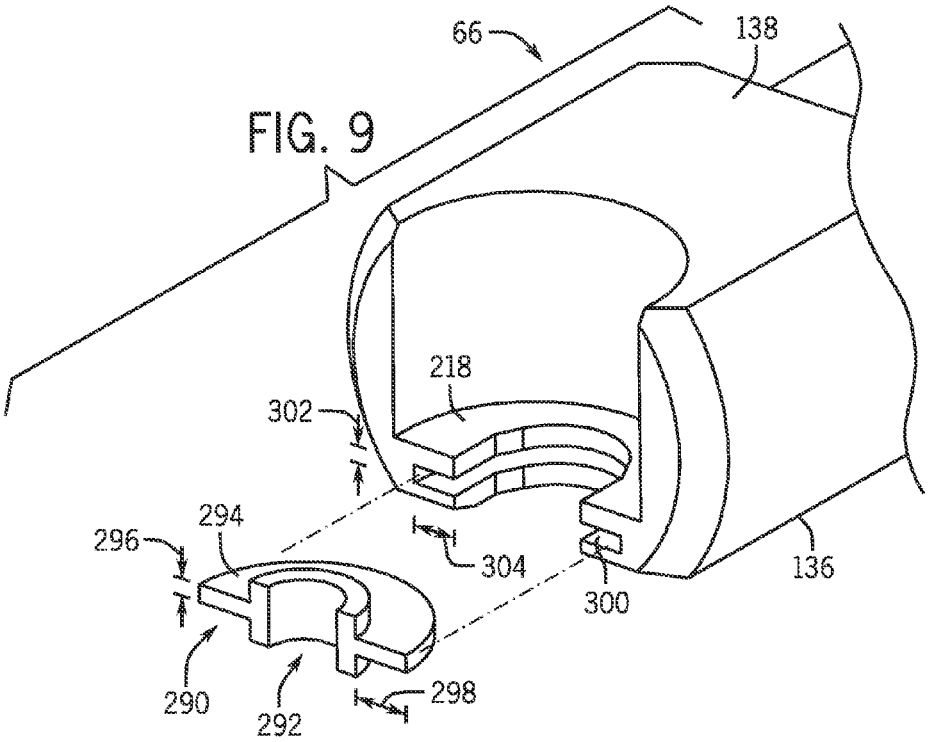

MULTI-BARRIER SEAL SYSTEM

CROSS-REFERENCE TO RELATED APPLICATION

This application claims priority to and benefit of U.S. application Ser. No. 13/528,773 entitled "Multi-Barrier Seal System," filed on Jun. 20, 2012, which is hereby incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Mineral extraction systems use auxiliary lines to assist in mineral extraction operations. Specifically, auxiliary lines may provide electrical power, fluids (e.g., chemicals), and equipment control. Mineral extraction operations place auxiliary lines in close contact with minerals, chemicals, and various fluids, which may corrosive, high pressure, and/or high temperature fluids (e.g., liquids, gases, etc.). In general, it is desirable to contain these fluids within conduits and other components of the mineral extraction system to avoid leakage into the environment.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 7 is a perspective view of a U-shaped recess having a shearing edge taken along line 7-7 of FIG. 6;

FIG. 8 is a perspective view of a V-shaped recess having a shearing edge taken along line 7-7 of FIG. 6;

FIG. 9 is a perspective view of an embodiment of a shearing ram with a removable shearing insert.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a multi-barrier seal system for an auxiliary line (or any other fluid line) in a mineral extraction system (or other system). For example, the multi-barrier seal system may include a first seal assembly and a second seal assembly. The second seal assembly may be a shear seal that seals off an auxiliary line while shearing through the auxiliary line. In some embodiments, the shear seal may include a shearing ram with a shearing edge. As the shearing edge shears an auxiliary line, the ram seals an auxiliary line passage. Advantageously, the shearing ram may only seal a first auxiliary line passage, lowering production costs.

In some embodiments, the shearing edge alters shearing stresses by changing its shape, and may include coatings to improve shearing. In still other embodiments, the shearing edge may be a removable insert that inserts into a shearing ram and is made from materials that differ from the ram. These materials may improve the shearing edge by increasing its hardness and sharpness. This also allows easy replacement, modification with one or more different base rams, i.e., it provides modularity.

Figure 1:
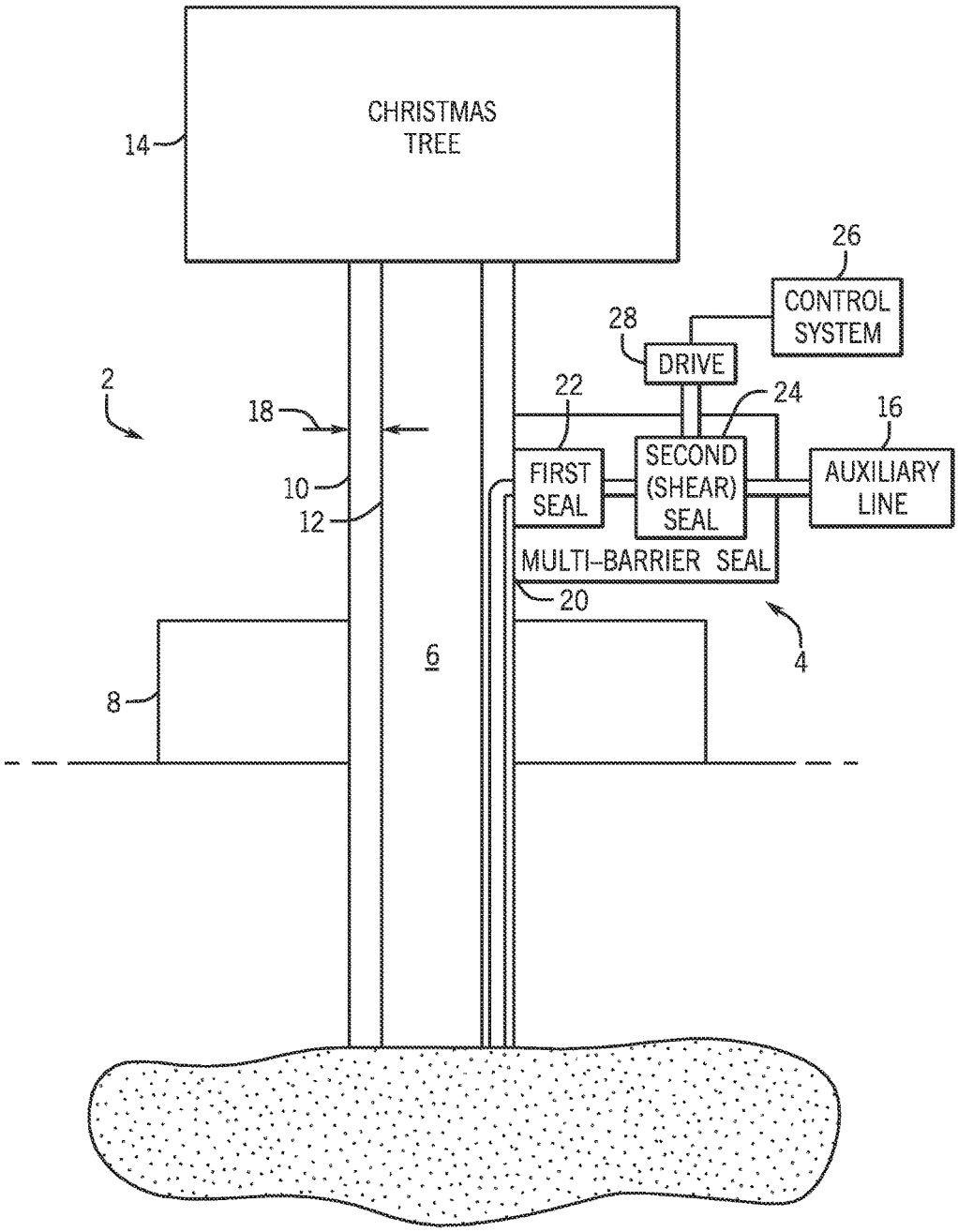
FIG. 1 is a schematic diagram of a mineral extraction system with a multi-barrier seal system.

FIG. 1 is a schematic diagram of a mineral extraction system 2 with a multi-barrier seal system 4. The mineral extraction system 2 may extract oil, natural gas, and other natural resources from a well 6. The mineral extraction system 2 includes the multi-barrier seal system 4, wellhead 8, a first pressure containing structure (e.g., pipe, conduit, tubular) 10, a second pressure containing structure (e.g., pipe, conduit, tubular) 12, a Christmas tree 14, and an auxiliary line 16. In mineral extraction operations, the system 2 removes minerals from the earth through the second pipe 12 to the Christmas tree 14 for shipment and later processing. As shown, the first pipe 10 surrounds the second pipe 12. The first pipe 10 is large enough to create a distance 18 between the first pipe 10 and the second pipe 12. This distance 18 (e.g., an annular space) provides enough space to insert an auxiliary line 16. This allows the auxiliary line 16 to run parallel to the first pipe 10 and the second pipe 12 down the well 6.

The auxiliary line 16 can serve several purposes in the well 6. These purposes include providing electricity to equipment, control of equipment, inserting or extracting fluids (i.e., chemicals), and communication with sensors. In general, the mineral extraction system 2 passes a variety of corrosive, high pressure, and/or high temperature fluids (e.g., liquids and gases), and it is generally desirable to contain these fluids within the system to avoid any leakage into the environment and/or exposure to operators. The multi-barrier seal system 4 does this by redundantly blocking material escape from a connection point 20 where the auxiliary line 16 enters the wellhead 8.

The multi-barrier seal system 4 includes a first seal assembly 22 and a second seal assembly 24, but could have any number of seals (e.g., 2, 3, 4, 5, or more seals). The combination of a first seal assembly 22 and a second seal assembly 24, or these two seal barriers 22 and 24 may be arranged in reverse order, provides extra protection through seal redundancy. In fact, the second seal assembly 24 may be a shear seal that cuts and seals the auxiliary line 16 in an emergency or at any other time. The second seal assembly 24 may activate through a control system 26 that sends a signal to a drive 28. Upon receiving the signal, the drive 28 activates forcing the second seal assembly 24 to shear and seal the auxiliary line 16. In other embodiments, the second seal assembly 24 may activate through manual force, e.g., via a manual actuator such as a wheel.

Figure 2:
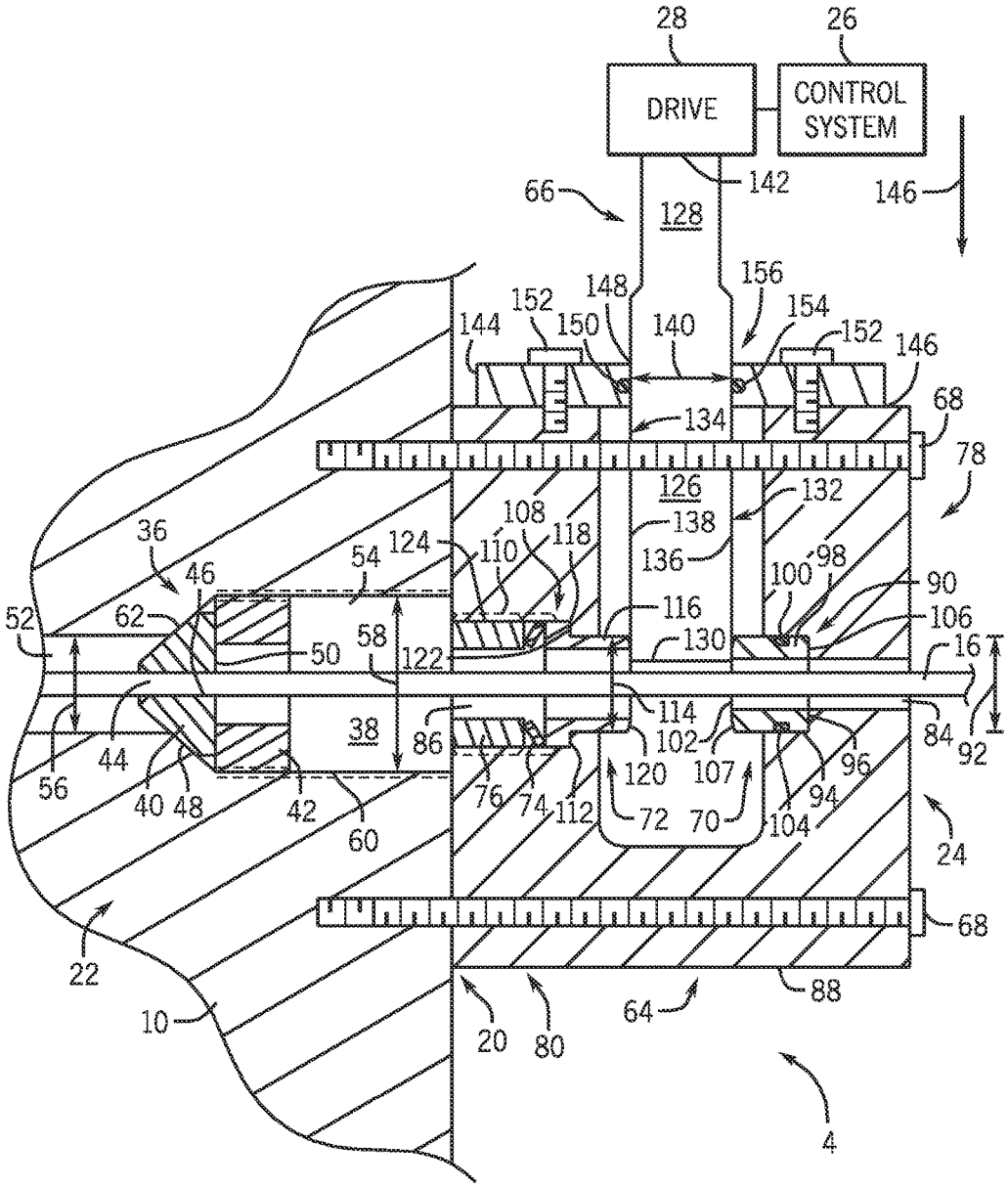
FIG. 2 is a cross-sectional view of an embodiment of a multi-barrier seal system including a first seal assembly and a second seal assembly.

FIG. 2 is a cross-sectional view of an embodiment of the multi-barrier seal system 4 including the first seal assembly 22 and the second seal assembly 24. In one embodiment, the first seal assembly 22 forms a first sealing barrier 36 with the auxiliary line 16 in an aperture 38 of the wellhead 8. The first seal assembly 22 includes a frusto conical sealing member 40 and a retaining nut 42. The frusto conical sealing member 40 includes an aperture 44 with an aperture surface 46, a pipe contact surface 48, and a rear surface 50.

The aperture 38 of wellhead 8 allows the auxiliary line 16 to pass through the wellhead 8. The aperture 38 includes a first portion 52 and a second portion 54. The first portion 52 defines diameter 56, while the second portion 54 defines a diameter 58 and threaded surface 60. As illustrated, the diameter 58 is greater than the diameter 56. The transition between the diameters 58 and 60 creates an aperture sealing surface 62 (e.g., conical sealing surface). This aperture sealing surface 62 contacts the pipe contact surface 48 of the frusto conical sealing member 40. The retaining nut 42 compressively holds the frusto conical sealing member 40 in contact with the aperture sealing surface 62 by threading into aperture 38 along threaded surface 60. The sealing contact between the frusto conical sealing member 40 and aperture sealing surface 62; and the sealing contact between the aperture surface 46 and the auxiliary line 16 form the first sealing barrier 36. This first sealing barrier 36 provides a first line of defense against leaking chemicals, gases, and oil (or any other fluids) from the wellhead 8 during mineral extraction operations.

The second seal assembly 24 includes a seal housing 64, shearing ram 66, retaining bolts 68, first seal insert 70, second seal insert 72, spring 74, and retaining nut 76. The housing 64 includes a first portion 78, a second portion 80, a shearing ram receptacle 82, a first line passage 84, a second line passage 86, and outer surface 88. As illustrated, the bolts 68 connect the seal housing 64 to the wellhead 8. This connection aligns the first line passage 84 and second line passage 86 with the aperture 38 of the wellhead 8. The passage alignment enables the auxiliary line 16 to pass through the second seal assembly 24, the first seal assembly 22, and through wellhead 8, while creating a fluid tight seal at connection point 20 between the wellhead 8 and the outer surface 88 of the housing 64 with gasket 89.

When assembled, the first line passage 84 receives the first seal insert 70; the second line passage 86 receives the second seal insert 72, spring 74, and retaining nut 76; and the shearing ram receptacle 82 receives the shearing ram 66 (e.g., only a single shearing ram). The first line passage 84 includes a counter bore or recess 90 that defines a diameter 92, a counter bore sealing surface 94, and counter bore mating surface 96. The counter bore 90 receives the first seal insert 70. The first seal insert 70 (e.g., annular insert) includes a body 98 and a gasket 100 (e.g., annular gasket or o-ring seal). The body defines an aperture 102, a gasket groove 104 (e.g., annular groove), a counter bore mating surface 106, and a shearing ram seal surface 107. The gasket groove 104 receives the gasket 100. The first seal insert 70 then forms a fluid tight seal with the counter bore 90 between the gasket 100 and the counter bore sealing surface 94, while the counter bore mating surface 96 contacts the counter bore contact surface 106 of the first seal insert 70.

The second line passage 86 defines a counter bore 108, threaded surface 110, insert contact surface 112, and an aperture diameter 114. The counter bore 108 receives the second insert 72. The second seal insert 72 (e.g., annular insert) includes a first annular portion 116 connected to a second annular portion 118 having a stepped construction. The first annular portion 116 defines a shearing ram contact surface 120 and a diameter less than or equal to diameter 114. In contrast, the second annular portion 118 has a diameter greater than diameter 114 and includes a counter bore contact surface 122. Thus, the first and second annular portions 116 and 118 define an intermediate step due to the change in diameters. This intermediate step allows the first annular portion 116 to pass through the counter bore 108 and into the shearing ram receptacle 82, while the second annular portion 118 contacts the insert contact surface 112 with counter bore contact surface 122. This intermediate step blocks the second seal insert 72 from completely passing through the counter bore 108 and into the shearing ram receptacle 82.

The spring 74 and the retaining nut 76 compressively retain the second seal insert 72 in the counter bore 108. Specifically, the spring 74 compresses axially against the second annular portion 118 of the second seal insert 72. This axial force compresses the second seal insert 72 against the counter bore insert contact surface 112. The spring 74 maintains this force with support from retaining nut 76 that threads into threaded surface 110 of counter bore 108 with threads 124.

The shearing ram 66 includes a first portion 126 and a second portion 128. The first portion 126 defines an open-ended edge 130, a first side 132, a second side 134, a sealing surface 136, a second seal insert contact surface 138, and defines a width 140. As illustrated, the sealing surface 136 is located on the first side 132, and second seal insert contact surface 138 is on the second side 134. The second portion 128 includes drive connector portion 142.

The first portion 126 of the shearing ram 66 passes through a seal ring (e.g., a bonnet) 144 and into the shearing ram receptacle 82. The seal ring 144 defines a seal surface 146, a ram aperture 148, and a gasket groove 150. When connecting the seal ring 144 to the housing 64 the seal surface 146 contacts and seals with the outer surface 88 with gasket 151 and remains in place with bolts 152. The gasket groove 150 receives a gasket 154 that contacts and creates a fluid tight seal 156 with the ram 66 or any part that is used to drive the ram, for example a stem. In some embodiments, the gasket 154 creates a fluid tight seal with the first portion 128.

Figure 3:
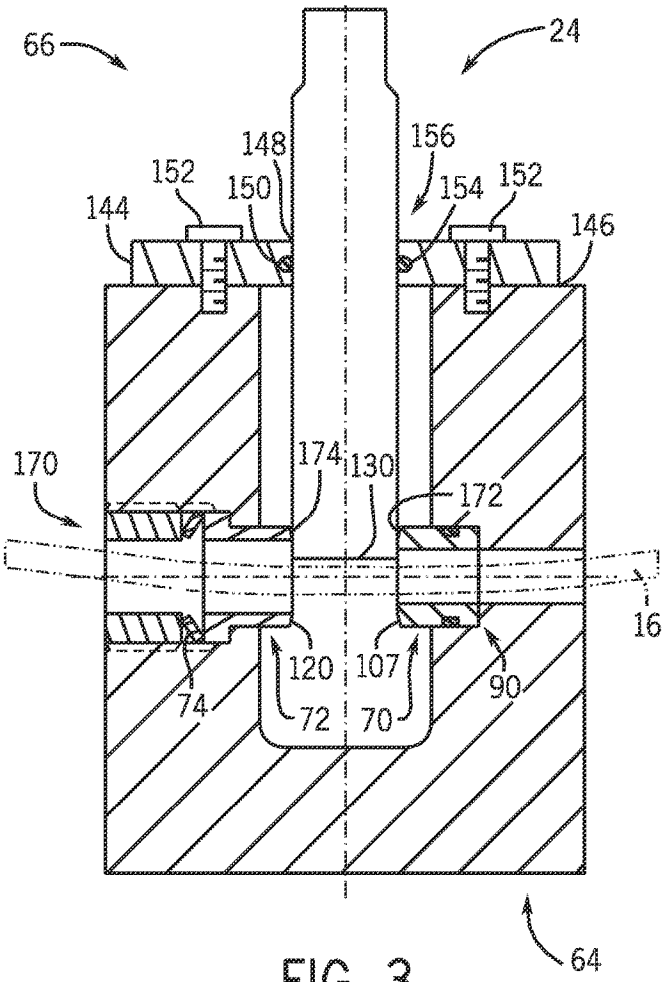
FIG. 3 is a cross-sectional view of the system of FIG. 2 with the second seal assembly in a first position.

FIG. 3 is a cross-sectional view of an embodiment of the second seal assembly 24 in a first position 170. In the first position 170, the shearing ram 66 rests between the first seal insert 70 and the second seal insert 72. More specifically, the shearing ram 66 rests against a portion 172 of the first seal insert 70 and a portion 174 of the second seal insert 72. This aligns the shearing ram 66 while simultaneously holding the first seal insert 70 within counter bore 90. More specifically, the first seal insert 70 floats in the counter bore 90 while the shearing ram 66, which is biased by the spring 74, holds it in place. In other embodiments, the first seal insert 70 may remain within the counter bore 90 by threading contact or with other fasteners.

Figure 4:
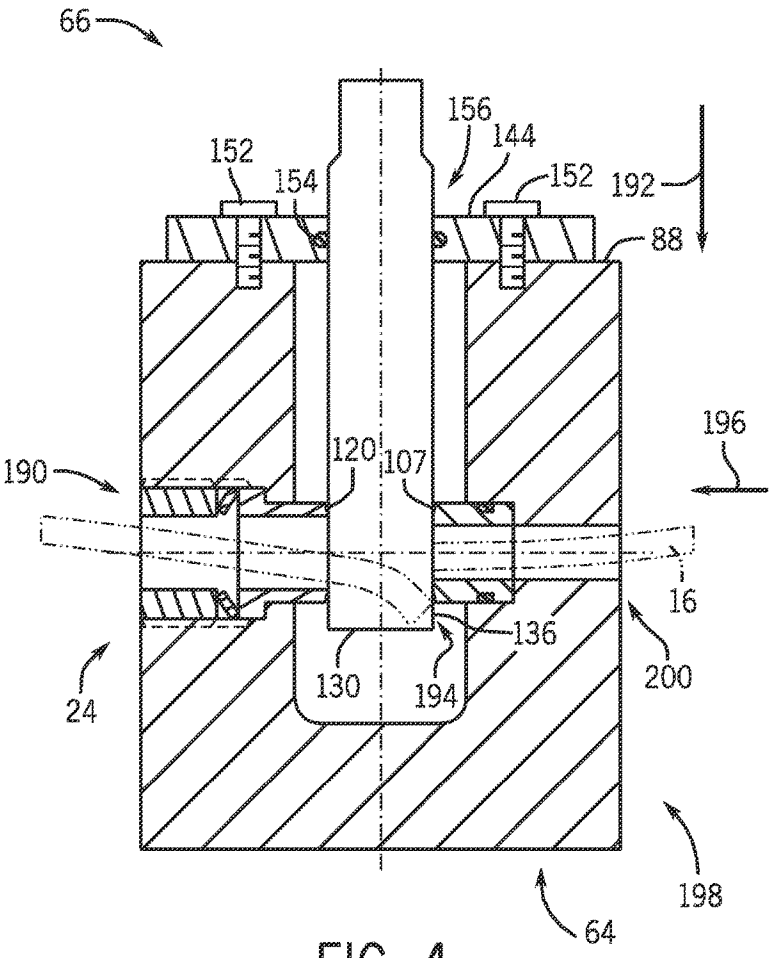
FIG. 4 is cross-sectional view of the system of FIG. 2 with the second seal assembly in a second or sealing position.

FIG. 4 is cross-sectional view of an embodiment of the second seal assembly 24 in a second or sealing position 190.

For example, in an emergency, the control system 26 may be programmed to activate the drive 28 that forces the shearing ram 66 in direction 192. As the shearing ram 66 moves in direction 192, the open ended edge 130 contacts and shears the auxiliary line 16 with a shearing edge (seen in FIGS. 5 and 6), while sliding along surfaces 107 and 120. This shearing action seals the first line passage 84 creating a fluid tight seal 194 between the shearing ram seal surface 107 and surface 136 of the shearing ram 66. The second insert 72, using spring 74, compressively keeps surfaces 107 and 120 in contact with ram 66 by limiting movement in the direction 196. In some embodiments, the tolerances between the first seal insert 70 and the second seal insert 72 are such that the ram 66 maintains sealing contact with surface 107 without the spring 74. Furthermore, in the disclosed embodiment, the second seal insert 72 does not form a fluid tight seal with the ram 66. However, alternative embodiments could create fluid tight seals between the ram 66 and the two inserts 70 and 72. Nevertheless, creating a seal with a single insert 70 or 72 may reduce costs, reduce driving force, and generally simplify construction. The combination of the fluid tight seal 156 and 194 form the second sealing barrier 198.

Figure 5:
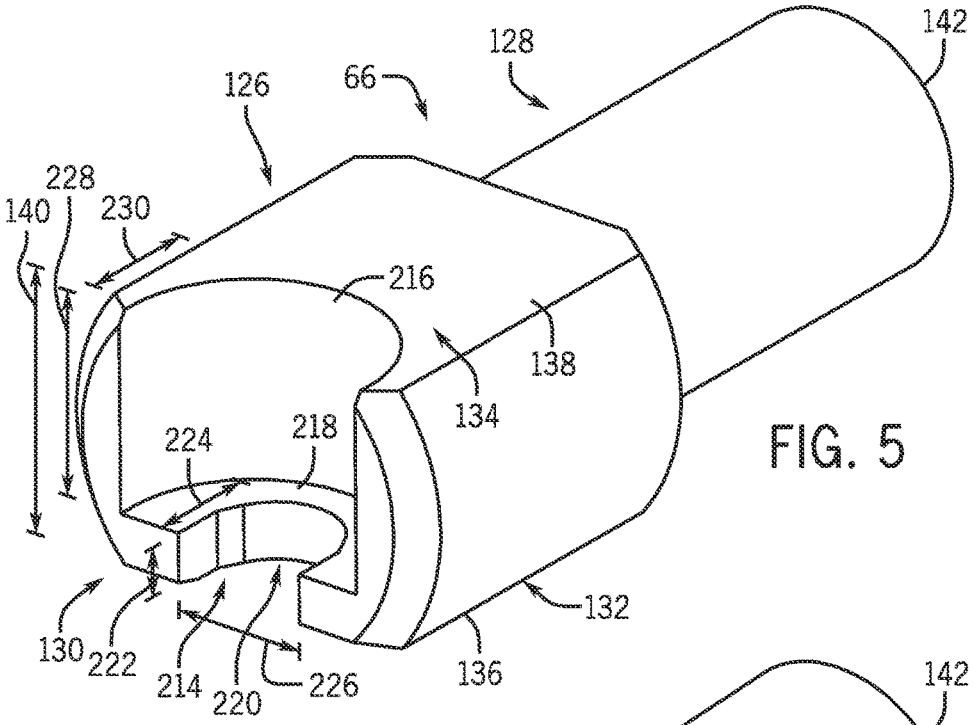
FIGS. 5 and 6 are perspective views of an embodiment of a shearing ram with a shearing edge.

FIG. 5 is a perspective view of an embodiment of a shearing ram 66 and its open-ended edge 130. As explained above, the shearing ram 66 includes a first portion 126 and a second portion 128. The first portion 126 defines an open-ended edge 130, a sealing surface 136, a second seal insert contact surface 138, and width 140. As illustrated, the open-ended edge 130 defines a recess 214 and a cavity 216. The recess 214 defines a recess surface 218 and a shear edge 220. The recess 214 extends a distance 222 from the seal surface 136 to the recess surface 218. The recess 216 also extends a distance 224 into the first portion 126, with a width 226. The width 226 is equal to or greater than the width of the auxiliary line 16. This sizing of the recess 214 enables the shearing ram 66 to capture and position the auxiliary line 16 for shearing with the shearing edge 220 between the shearing ram 66 and the first insert 70.

The cavity 216 extends from the second seal insert contact surface 138 to the recess surface 218. This distance 228 is the difference between distances 140 and 222. The cavity 216 may also extend a distance 230 into the first portion 126. In some embodiments, optimizing the cavity 216 may increase shearing forces at the shearing edge 220. For example, an increase in the cavity size 216 causes a decrease in the size of recess 214 and shearing edge 216. This reduction in size increases/focuses shearing forces into a smaller region, (e.g., sharper and/or thinner shearing edge) which may improve shearing of auxiliary line 16. An improved shear may improve the fluid tight seal 192 and decrease force requirements on the drive 28.

Figure 6:
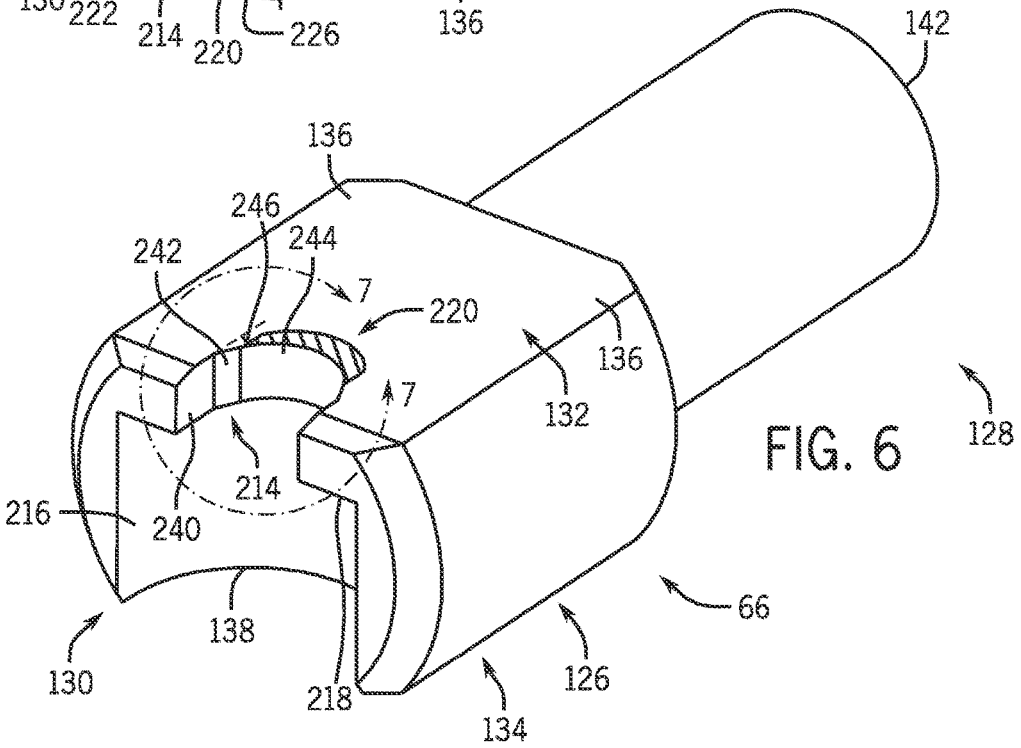

FIG. 6 is an alternate perspective view of the shearing ram 66 in FIG. 5. As illustrated, the shearing edge 220 may form different regions 240, 242, and 244. These regions 240, 242, and 244 may perform different functions for the shearing edge 220. For example, region 240 may be a restraining region that blocks the auxiliary line 16 from escaping once it enters the recess 214. Region 242 may be a guiding region, (e.g., converging region) which guides the auxiliary line to a shearing region 244. The guiding region 242 may form an angle 246 with the restraining region 240 that optimally guides the auxiliary line 16 into the shearing region 244.

FIG. 7 is a perspective view of a U-shaped recess 258 having a shearing edge 260 taken along line 7-7 of FIG. 6. In FIG. 7, the shearing edge 260 angles toward a shearing line or plane 262 from the sealing surface 136 and the recess surface 218. In this embodiment, the shearing edge 260 focuses the maximum shearing forces to the shearing line 262. In the present embodiment, the line 262 is approximately halfway between the sealing surface 136 and the recess surface 218. In other embodiments, the position of shearing line 262 may change depending on angles 264 and 266. For example, angles 264 and 266 may form respective angles of 15, 20, 25, 30, 35, 40, 90, 150, or 180 degrees, and combinations thereof. Furthermore, by increasing angle 264 and reducing angle 266 the shearing line 262 moves closer to sealing surface 136. Likewise, reducing angle 264 and increasing angle 266 moves the shearing line 262 closer to recess edge 218. The change in angles may optimize shearing forces for different auxiliary lines 16.

FIG. 8 is a perspective view of a V-shaped recess 278 having a shearing edge 280 taken along line 7-7 of FIG. 6. In FIG. 8, the angle 264 increases to 180 degrees moving the shearing line 262 to the sealing face 136. In some embodiments, the shearing edge 280 includes a coating 282. These coatings may be harder and more wear resistant than the base material or ram material. The coating 282 may be a carbide (e.g., tungsten carbide, chromium carbide) or an oxide (e.g., chromium oxide, aluminum oxide) or another kind of coating that increases hardness or other desired characteristic. Furthermore, the V-shaped recess may form several angles 284 depending on the application (e.g., 15, 20, 25, 30, 35, 40, 90, 150, or 180 degrees).

FIG. 9 is a perspective view of an embodiment of the shearing ram 66 with a removable shearing edge insert 290. In some embodiments, the shearing ram 66 may be capable of receiving a removable shearing edge insert 290 with a shearing edge 292. The removable shearing edge insert 290 may improve shearing ability by increasing hardness and forming a sharper shearing edge than the material that forms the shearing ram 66. For example, the ram 66 may be formed from steel, while the insert 292 is formed from a carbide or another kind of metal for improved shearing ability. Moreover, the different possible shearing edge types (e.g., V-shaped, U-shaped, flat, smooth, serrated) and associated coatings provide a variety or family of insert 290 options that may combine with one or more different base rams. This interchangeability or modularity may reduce costs and provide flexible solutions for shearing different auxiliary lines 16.

The shearing edge insert 290 includes a semi-annular flange 294 connected to the shearing edge 292. The semi-annular flange 294 defines a height of 296 and a width 298. In some embodiments, the shearing edge material 292 is the same as or different from the semi-annular flange 294. In order to receive the semi-annular flange 294 the ram 66 forms a flange receiving groove 300 between the recess surface 218 and the sealing surface 136. The groove 300 defines a height 302 and a width 304 capable of receiving and holding the semi-annular flange 294 in place while shearing the auxiliary line 16. In other embodiments, latches, fasteners, etc., may hold the shearing edge insert 290 in place.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a seal assembly, comprising:

a seal housing;

a ram receptacle extending through the seal housing; and a shearing ram disposed in the ram receptacle and configured to move along a first axis within the ram receptacle to shear an auxiliary line, wherein the shearing ram is the only shearing ram disposed in the ram receptacle, the shearing ram comprises a recess formed in a sealing surface of the shearing ram, and wherein the recess extends a first distance along the first axis, the recess defines a first width along a second axis perpendicular to the first axis, the recess is open at a distal end of the shearing ram, and the recess defines a shearing edge configured to shear the auxiliary line, wherein the shearing ram comprises a second surface opposite the sealing surface, the second surface defining a cavity that is open to the distal end of the shearing ram, the cavity extends a second distance along the first axis, and the cavity defines a second width, and wherein the first width is less than the second width and the first distance is less than the second distance.

2. The system of claim 1, wherein the recess and the cavity form a continuous space open to the distal end of the shearing ram that enables the auxiliary line to extend through both the recess and the cavity prior to shearing of the auxiliary line by the shearing ram.

3. The system of claim 2, wherein the recess comprises a first thickness along a third axis perpendicular to the first axis, the cavity comprises a second thickness along the third axis, and the second thickness is greater than the first thickness.

4. The system of claim 1, wherein the seal housing comprises a first auxiliary line passage and a second auxiliary line passage each configured to support the auxiliary line, and the ram receptacle extends through the seal housing between the first auxiliary line passage and the second auxiliary line passage.

5. The system of claim 4, wherein the shearing ram is configured to seal only one of the first auxiliary line passage and the second auxiliary line passage after shearing the auxiliary line.

6. The system of claim 1, comprising an insert within the ram receptacle, wherein the insert is configured to form a seal with the shearing ram.

7. The system of claim 6, comprising a spring, wherein the spring is configured to bias the shearing ram against the insert to form the seal.

8. A system, comprising:

a shearing ram configured to shear through an auxiliary line of a mineral extraction system, the shearing ram comprising:

a first surface, wherein the first surface is configured to form a seal;

a first recess formed in the first surface, wherein the first recess is open at a distal end of the shearing ram and defines a shearing edge configured to shear the auxiliary line;

a spring, wherein the spring is configured to bias the first surface of the shearing ram to form the seal; and a retaining nut, wherein the retaining nut is configured to bias the spring.

9. The system of claim 8, wherein the shearing ram comprises a second surface opposite the first surface, and wherein the first recess extends from the first surface to the second surface.

10. The system of claim 8, wherein the shearing ram comprises a second surface opposite the first surface, and wherein a second recess is formed in the second surface, the second recess is open to the distal end of the shearing ram, and the first recess and the second recess form a continuous space extending between the first surface and the second surface and open to the distal end of the shearing ram to enable the auxiliary line to extend through both the first recess and the second recess prior to shearing of the auxiliary line by the shearing ram.

11. The system of claim 10, wherein the first recess has a first width, a first height, and a first depth, and the second recess has a second width, a second height, and a second depth, and wherein the second width is greater than the first width, the second height is greater than the first height, and the second depth is greater than the first depth.

12. The system of claim 8, wherein the shearing edge is positioned on the first surface.

13. The system of claim 8, wherein the shearing ram is part of a sealing assembly, and the shearing ram is configured to provide a sealing barrier between an auxiliary line passage and the mineral extraction system.

14. The system of claim 8, wherein the first surface comprises a sealing surface configured to contact and to seal an auxiliary line passage of the mineral extraction system after the shearing ram shears the auxiliary line.

15. The system of claim 8, comprising a seal housing having opposite first and second housing portions disposed about a ram receptacle, wherein the first housing portion comprises a first auxiliary line passage, the second housing portion comprises a second auxiliary line passage aligned with the first auxiliary line passage, and the shearing ram is disposed in the ram receptacle, wherein the seal housing is configured to pass the auxiliary line through the first auxiliary line passage, the ram receptacle, and the second auxiliary line passage.

16. The system of claim 8, wherein the first recess comprises a U-shape or a V-shape.

17. The system of claim 8, wherein the shearing edge comprises a removable shearing edge insert configured to be removably coupled to the first recess.

18. A method, comprising:

moving a shearing ram through a ram receptacle of a seal housing, wherein the shearing ram is the only shearing ram disposed in the ram receptacle;

receiving an auxiliary line of a mineral extraction system into a recess formed in a sealing surface of the shearing ram and open at a distal end of the shearing ram when the shearing ram is moved to a first position within the ram receptacle;

shearing the auxiliary line with a shearing edge defined by the recess when the shearing ram is moved to a second position within the ram receptacle; and sealing an auxiliary line passage supporting the auxiliary line by biasing the shearing ram with a spring to form a sealing barrier between the sealing surface of the shearing ram and the auxiliary line passage, wherein the spring is biased with a retaining nut.

* * * * *